US009284152B2

(12) United States Patent
Yamashita et al.

(10) Patent No.: US 9,284,152 B2
(45) Date of Patent: Mar. 15, 2016

(54) POST-PROCESSING DEVICE AND IMAGE FORMING APPARATUS

(71) Applicant: KYOCERA Document Solutions Inc., Osaka (JP)

(72) Inventors: Keisuke Yamashita, Osaka (JP); Hideo Tanii, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/620,466

(22) Filed: Feb. 12, 2015

(65) Prior Publication Data

US 2015/0225200 A1 Aug. 13, 2015

(30) Foreign Application Priority Data

Feb. 13, 2014 (JP) ..... 2014-025666

(51) Int. Cl.

*B65H 37/04* (2006.01)
*B65H 43/00* (2006.01)
*B65H 31/34* (2006.01)
*B65H 33/08* (2006.01)

(52) U.S. Cl.

CPC ..... *B65H 37/04* (2013.01); *B65H 31/34* (2013.01); *B65H 33/08* (2013.01); *B65H 43/00* (2013.01); *B65H 2301/4212* (2013.01); *B65H 2301/4213* (2013.01); *B65H 2405/114* (2013.01); *B65H 2408/1222* (2013.01); *B65H 2511/51* (2013.01); *B65H 2511/515* (2013.01); *B65H 2801/27* (2013.01)

(58) Field of Classification Search

CPC ..... B65H 37/04
USPC ..... 270/58.08; 399/410
See application file for complete search history.

(56) References Cited

U.S. PATENT DOCUMENTS

H1842 H * 3/2000 Tontarski ..... B27F 7/19 227/100
6,155,552 A * 12/2000 Hirai ..... B65H 39/11 270/58.16
6,741,817 B2 * 5/2004 Seto ..... G03G 15/6582 399/75
6,983,931 B2 * 1/2006 Kaneko ..... B42C 1/12 270/32
7,293,766 B2 * 11/2007 Ruthenberg ..... B42C 1/12 270/37
7,413,180 B2 * 8/2008 Kobayashi ..... B42C 1/12 270/58.07
8,079,583 B2 * 12/2011 Milillo ..... B42C 1/125 270/52.18
2007/0138729 A1 * 6/2007 Terao ..... B42C 1/12 270/58.09
2007/0138731 A1 * 6/2007 Terao ..... B42C 1/125 270/58.12
2008/0187383 A1 * 8/2008 Yamamoto ..... B65H 9/101 399/410
2009/0166946 A1 * 7/2009 Iguchi ..... B65H 31/10 270/58.08
2015/0183255 A1 * 7/2015 Nakagomi ..... B65H 37/04 412/11

FOREIGN PATENT DOCUMENTS

JP 2002-264105 9/2002

* cited by examiner

*Primary Examiner* — Patrick Mackey

(57) ABSTRACT

A post-processing device includes: a tray; a sheet output section; a stapler provided movably in a direction perpendicular to a direction of discharge of a stack of paper sheets and configured to apply staples to a plurality of locations on the stack of paper sheets loaded on the tray; a sheet stack shifting section configured to shift the stack of paper sheets loaded on the tray in the direction perpendicular to the direction of discharge of the stack; and an operation control section configured to allow the stapler to apply a staple to a first location on the stack of paper sheets and then allow the stapler to move to a position corresponding to a location to be stapled next while allowing the sheet stack shifting section to shift the stack in a direction opposite to a direction of the movement of the stapler.

7 Claims, 9 Drawing Sheets

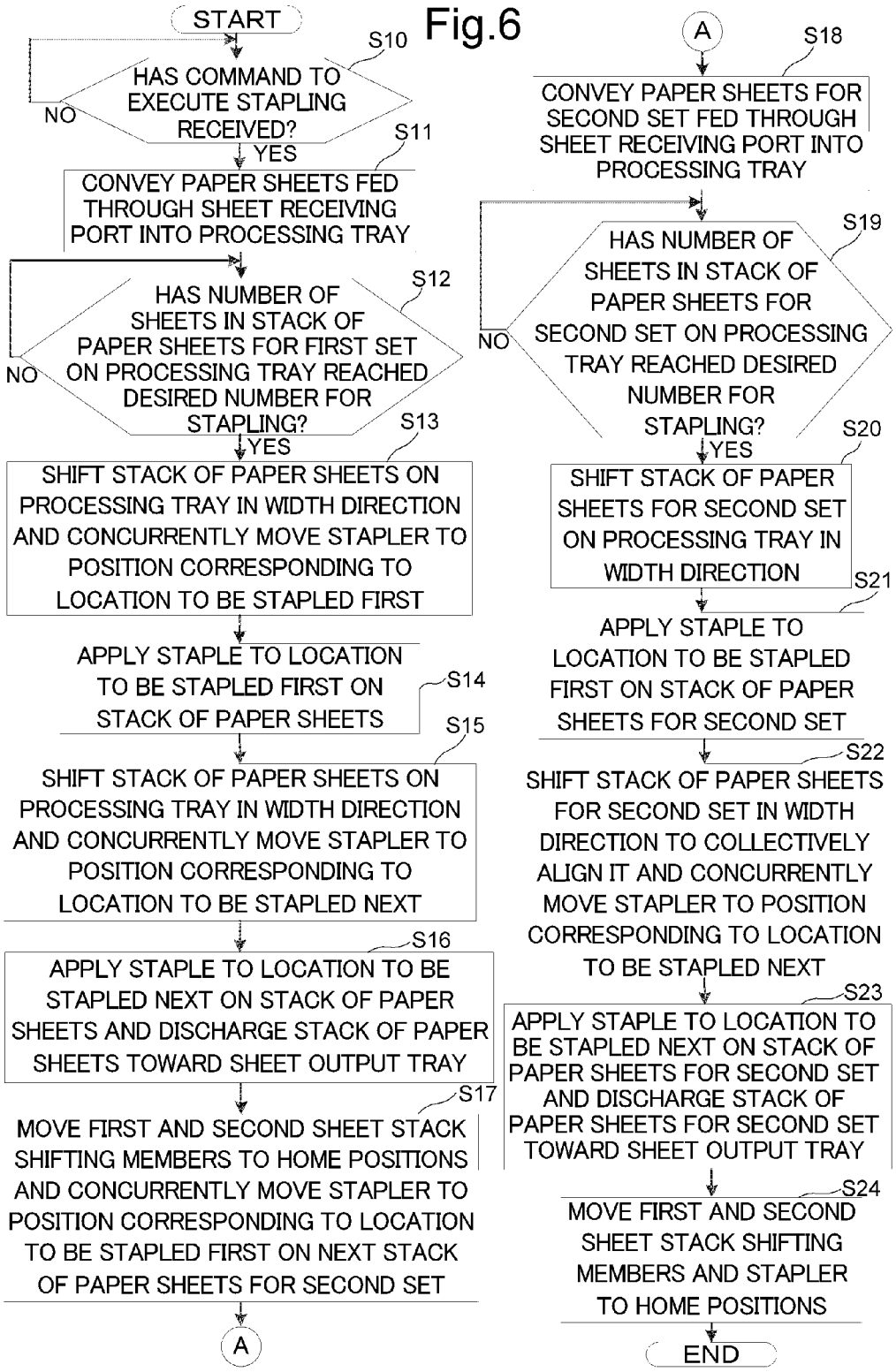
Fig.6
START
S10
HAS COMMAND TO EXECUTE STAPLING RECEIVED?
NO
YES
S11
CONVEY PAPER SHEETS FED THROUGH SHEET RECEIVING PORT INTO PROCESSING TRAY
S12
HAS NUMBER OF SHEETS IN STACK OF PAPER SHEETS FOR FIRST SET ON PROCESSING TRAY REACHED DESIRED NUMBER FOR STAPLING?
NO
YES
S13
SHIFT STACK OF PAPER SHEETS ON PROCESSING TRAY IN WIDTH DIRECTION AND CONCURRENTLY MOVE STAPLER TO POSITION CORRESPONDING TO LOCATION TO BE STAPLED FIRST
S14
APPLY STAPLE TO LOCATION TO BE STAPLED FIRST ON STACK OF PAPER SHEETS
S15
SHIFT STACK OF PAPER SHEETS ON PROCESSING TRAY IN WIDTH DIRECTION AND CONCURRENTLY MOVE STAPLER TO POSITION CORRESPONDING TO LOCATION TO BE STAPLED NEXT
S16
APPLY STAPLE TO LOCATION TO BE STAPLED NEXT ON STACK OF PAPER SHEETS AND DISCHARGE STACK OF PAPER SHEETS TOWARD SHEET OUTPUT TRAY
S17
MOVE FIRST AND SECOND SHEET STACK SHIFTING MEMBERS TO HOME POSITIONS AND CONCURRENTLY MOVE STAPLER TO POSITION CORRESPONDING TO LOCATION TO BE STAPLED FIRST ON NEXT STACK OF PAPER SHEETS FOR SECOND SET
A
A
S18
CONVEY PAPER SHEETS FOR SECOND SET FED THROUGH SHEET RECEIVING PORT INTO PROCESSING TRAY
S19
HAS NUMBER OF SHEETS IN STACK OF PAPER SHEETS FOR SECOND SET ON PROCESSING TRAY REACHED DESIRED NUMBER FOR STAPLING?
NO
YES
S20
SHIFT STACK OF PAPER SHEETS FOR SECOND SET ON PROCESSING TRAY IN WIDTH DIRECTION
S21
APPLY STAPLE TO LOCATION TO BE STAPLED FIRST ON STACK OF PAPER SHEETS FOR SECOND SET
S22
SHIFT STACK OF PAPER SHEETS FOR SECOND SET IN WIDTH DIRECTION TO COLLECTIVELY ALIGN IT AND CONCURRENTLY MOVE STAPLER TO POSITION CORRESPONDING TO LOCATION TO BE STAPLED NEXT
S23
APPLY STAPLE TO LOCATION TO BE STAPLED NEXT ON STACK OF PAPER SHEETS FOR SECOND SET AND DISCHARGE STACK OF PAPER SHEETS FOR SECOND SET TOWARD SHEET OUTPUT TRAY
S24
MOVE FIRST AND SECOND SHEET STACK SHIFTING MEMBERS AND STAPLER TO HOME POSITIONS
END

POST-PROCESSING DEVICE AND IMAGE FORMING APPARATUS

INCORPORATION BY REFERENCE

This application claims priority to Japanese Patent Application No. 2014-025666 filed on Feb. 13, 2014, the entire contents of which are incorporated by reference herein.

BACKGROUND

The present disclosure relates to post-processing devices mounted to image forming apparatuses, such as copiers and printers, and configured to apply staples to paper sheets and image forming apparatuses with the same.

There are known post-processing devices configured to subject to post-processing, such as stapling, paper sheets having images formed thereon by an image forming apparatus. In such a post-processing device, a stack of paper sheets loaded on a dedicated tray provided inside the device is shifted in a width direction of the stack by a sheet stack shifting section and thus collectively aligned and the aligned stack of paper sheets is then subjected to a stapling process by a stapler. In the stapling process, the stapler applies staples to a plurality of locations on the stack of paper sheets by first applying a staple to one location on the stack, then moving in the width direction of the stack, then applying a staple to the next location on the stack, and thereafter repeating the same procedure. After the stapling, the post-processing device allows the sheet stack shifting section to shift the stack of paper sheets to a predetermined discharge position and discharges the stack toward an output tray provided outside the device.

SUMMARY

A technique improved over the aforementioned technique is proposed as one aspect of the present disclosure.

A post-processing device according to an aspect of the present disclosure includes a tray, a sheet output section, a stapler, a sheet stack shifting section, and an operation control section.

The tray is capable of being loaded with a stack of paper sheets to be stapled.

The sheet output section is configured to discharge the stapled stack of paper sheets from the tray.

The stapler is provided movably in a direction perpendicular to a direction of the discharge of the stack of paper sheets and configured to apply staples to a plurality of locations on the stack of paper sheets loaded on the tray.

The sheet stack shifting section is configured to shift the stack of paper sheets loaded on the tray in the direction perpendicular to the direction of the discharge of the stack.

The operation control section is configured to control operations of the stapler and the sheet stack shifting section.

Specifically, the operation control section allows the stapler to apply a staple to a first one of the locations on the stack of paper sheets and then allows the stapler to move to a position corresponding to a second one of the locations to be stapled next on the stack of paper sheets while allowing the sheet stack shifting section to shift the stack of paper sheets in a direction opposite to a direction of the movement of the stapler.

An image forming apparatus according to another aspect of the present disclosure includes the aforementioned post-processing device and an image forming section.

BRIEF DESCRIPTION OF THE DRAWINGS

FIG. 6 is a flowchart showing a flow of processing of the post-processing device according to the one embodiment of the present disclosure.

DETAILED DESCRIPTION

Figure 1:
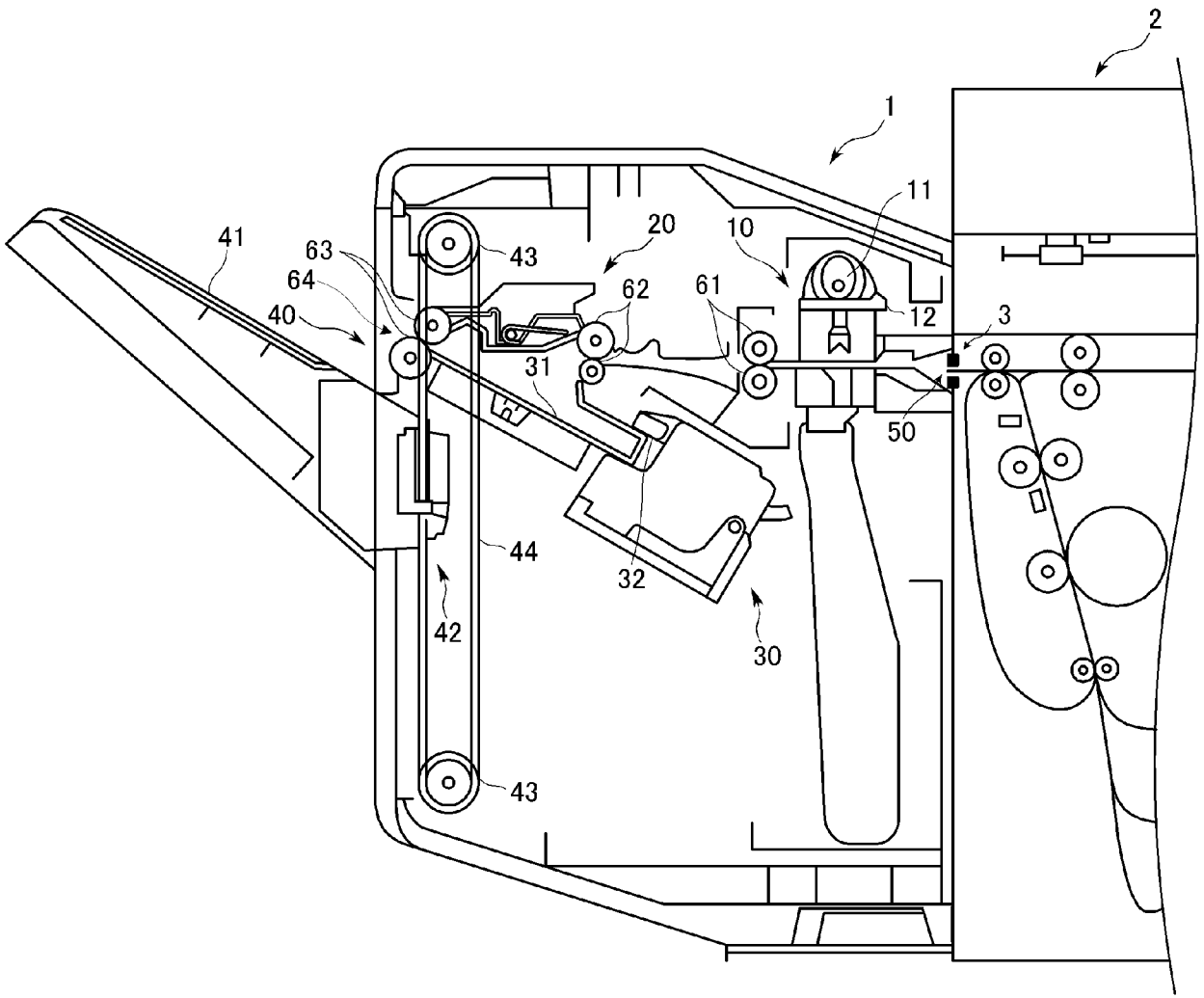
FIG. 1 shows the structure of a post-processing device according to one embodiment of the present disclosure.

Hereinafter, a description will be given of a post-processing device according to one embodiment of the present disclosure and an image forming apparatus with the same with reference to the drawings. FIG. 1 shows the structure of the post-processing device according to the one embodiment of the present disclosure.

The post-processing device 1 includes a punching section 10, a sheet stack shifting section 20, a stapling section 30, and a sheet output section 40. The post-processing device 1 is connected to an image forming apparatus 2 to receive through a sheet receiving port 50 a paper sheet which has an image formed by an image forming section (not shown) of the image forming apparatus 2 and has been discharged through a sheet discharge port 3 of the image forming apparatus 2. Furthermore, the post-processing device 1 and the image forming apparatus 2 are connected via an unshown communication cable to enable data communications therebetween through a communication interface section 70 (see FIG. 5) to be described hereinafter.

The paper sheet fed through the sheet receiving port 50 is conveyed by conveyance roller pairs 61, 62, 63. The paper sheet or a stack of paper sheets undergoes post-processing, such as punching or stapling, at a predetermined location in the interior of the post-processing device 1 and the post-processed paper sheet or stack of paper sheets is discharged through a sheet output port 64 onto an output tray 41 of the sheet output section 40.

The sheet output section 40 includes an elevating mechanism 42. The elevating mechanism 42 includes: a pair of pulleys 43 operable to be rotated by a drive force applied from an unshown drive source; and a belt 44 mounted on the pair of pulleys 43 and operable to rotate with the rotation of the pulleys 43. The output tray 41 is attached at its side to the belt 44 and configured to be elevated or lowered by the elevating mechanism 42 so that the upper surface of the discharged stack of paper sheets comes to an appropriate level.

The punching section 10 is configured so that in response to a command to execute punching serving as one of post-processing functions, an unshown motor is driven into rotation to rotate a cam 11. The rotation of the cam 11 causes a punching blade 12 to move up and down to punch holes at predetermined locations in the paper sheet fed to the sheet receiving port 50. The punching section 10 of the post-processing device 1 in this embodiment is provided with a pair of cams 11 and a pair of punching blades 12, each pair disposed at a predetermined distance in the width direction of the paper sheet, so that two holes can be punched at a leading end or trailing end of the paper sheet conveyed.

The stapling section 30 includes: a dedicated processing tray 31 on which a stack of paper sheets to be stapled can be loaded; and a stapler 32 slidable in a width direction of the stack of paper sheets (a direction perpendicular to the direction of discharge of the stack of paper sheets).

Figure 2:
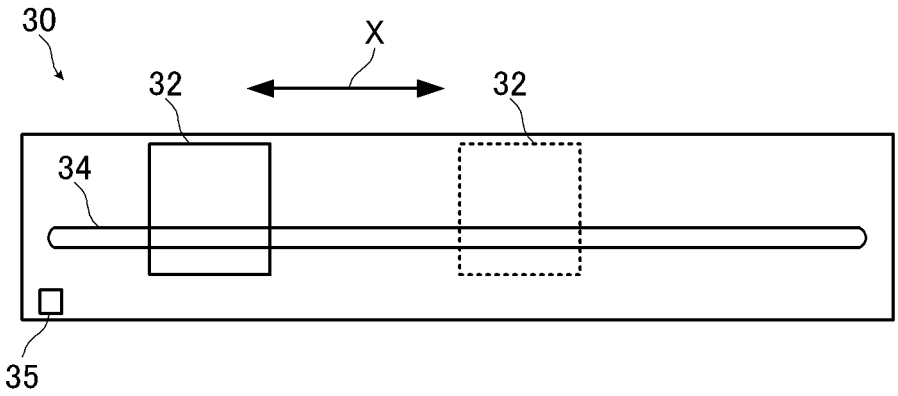
FIG. 2 shows a slide mechanism of a stapler of the post-processing device according to the one embodiment of the present disclosure.

FIG. 2 shows a slide mechanism of the stapler 32. A housing of the stapling section 30 is provided with a guide 34 extending along the width direction of the stack of paper sheets. Under the control of an operation control section 102 (see FIG. 5) to be described hereinafter, the stapler 32 can be driven by a drive section 33 to slide in the width direction of the stack of paper sheets (the direction of the arrow X in FIG. 2) and can apply staples to predetermined locations on the stack of paper sheets loaded on the processing tray 31.

The housing of the stapling section 30 is further provided with a position sensor 35 configured to detect the position of the stapler 32. The position sensor 35 is formed of, for example, a so-called reflective optical sensor and configured to output a high-level signal when the stapler 32 is at a predetermined home position and output a low-level signal when the stapler 32 is not at the predetermined home position.

Figure 3A:
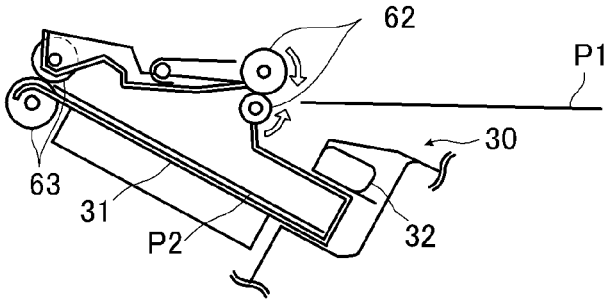
FIGS. 3A, 3B, and 3C show a flow of a paper sheet in a stapling process of a stapling section of the post-processing device according to the one embodiment of the present disclosure.
Figure 3B:
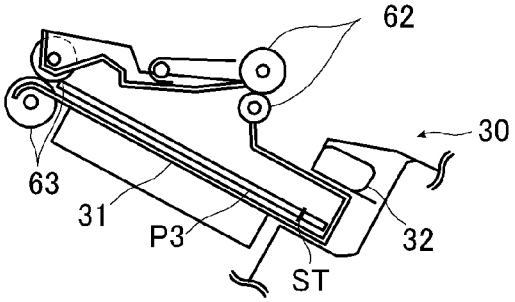
Figure 3C:
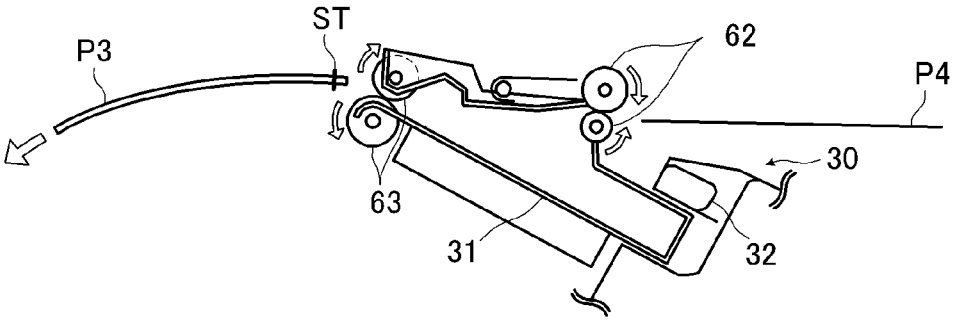

FIGS. 3A, 3B, and 3C show a flow of a paper sheet in a stapling process of the stapling section 30.

As shown in FIG. 3A, a paper sheet P1 fed through the sheet receiving port 50 and then conveyed by the conveyance roller pair 61 is nipped between the conveyance roller pair 62 and conveyed into the processing tray 31 by the rotation of the conveyance roller pair 62 in the directions shown by the open arrows in the figure. The paper sheet P1 is laid on a paper sheet P2 already loaded on the processing tray 31. When thereafter a stack of paper sheets loaded on the processing tray 31 reaches a predetermined number of paper sheets, the stack of paper sheets on the processing tray 31 is shifted in the width direction and thus collectively aligned by the sheet stack shifting section 20 described later.

Then, as shown in FIG. 3B, the stapler 32 of the stapling section 30 drives one or more staples ST into the stack of paper sheets P3 aligned by the sheet stack shifting section 20. Where in the stack to drive staples may be two locations a predetermined distance apart in the width direction of the paper sheet (two-point binding) or a single location such as a sheet corner (single-point binding). Alternatively, staples may be applied to two locations in the middle of the paper sheets (saddle stitch binding). In applying staples ST to a plurality of locations on the stack of paper sheets P3, the stapler 32 first applies a staple ST to one location on the stack of paper sheets P3, then moves in the width direction of the stack of paper sheets P3, and applies a staple ST to the next location.

As shown in FIG. 3C, after the above stapling process, the conveyance roller pair 63 rotates in the directions shown by the open arrows in the figure, so that the stack of paper sheets P3 into which the staples ST have been driven is nipped between the conveyance roller pair 63 and discharged toward the output tray 41 disposed outside the post-processing device 1.

Figure 4:
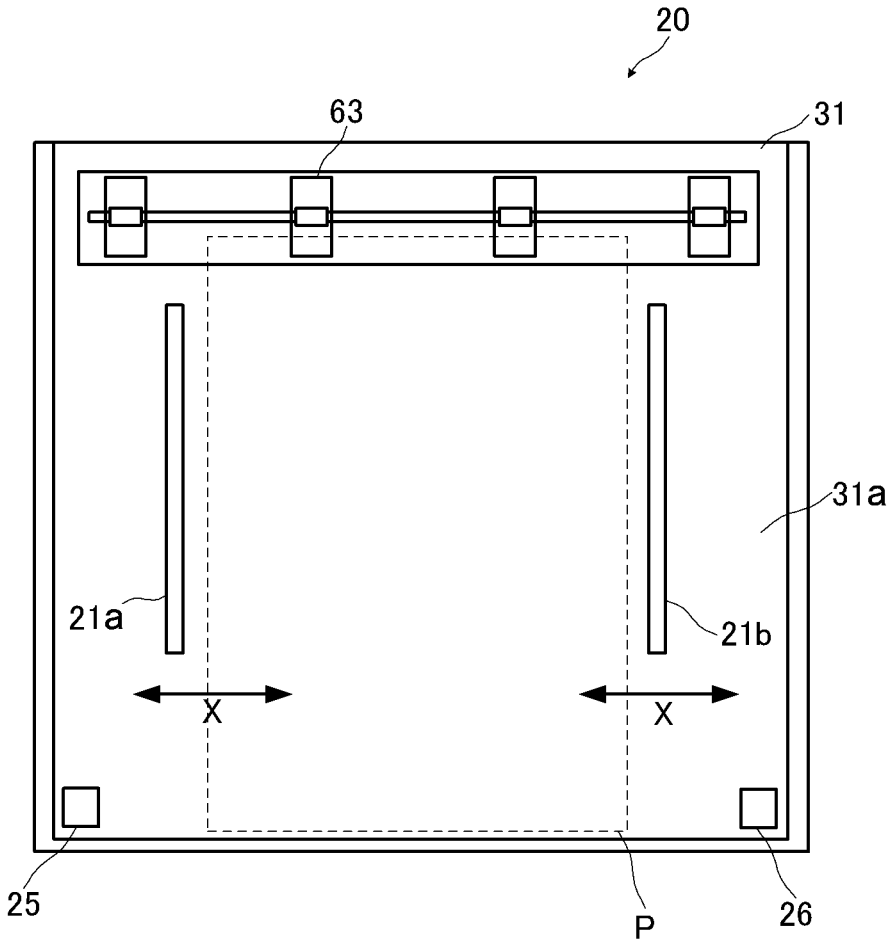
FIG. 4 shows the structure of a sheet stack shifting section of the post-processing device according to the one embodiment of the present disclosure.

FIG. 4 shows the structure of the sheet stack shifting section 20. In the example shown in this figure, a stack of paper sheets P is loaded on the upper surface 31*a* of the processing tray 31. The sheet stack shifting section 20 includes a pair of sheet stack shifting members (i.e., a first sheet stack shifting member 21*a* and a second sheet stack shifting member 21*b*) provided on the upper surface 31*a* of the processing tray 31. The first and second sheet stack shifting members 21*a*, 21*b* extend along the direction of conveyance of the stack of paper sheets P and are movable in the width direction of the stack of paper sheets P (the direction of the arrows X in FIG. 4) independently of each other. The first and second sheet stack shifting members 21*a* and 21*b* can be driven by drive sections 23 and 24, respectively, under the control of the operation control section 102 (see FIG. 5) to be described hereinafter to move in the width direction of the stack of paper sheets P and thus shift the stack of paper sheets P loaded on the processing tray 31 in the width direction of the stack of paper sheets P.

Further provided on the upper surface 31*a* of the processing tray 31 are a position sensor 25 capable of detecting the position of the first sheet stack shifting member 21*a* and a position sensor 26 capable of detecting the position of the second sheet stack shifting member 21*b*. The position sensor 25 is configured to output a high-level signal when the first sheet stack shifting member 21*a* is at a predetermined home position and output a low-level signal when the first sheet stack shifting member 21*a* is not at the predetermined home position. The position sensor 26 is configured to output a high-level signal when the second sheet stack shifting member 21*b* is at a predetermined home position and output a low-level signal when the second sheet stack shifting member 21*b* is not at the predetermined home position.

Figure 5:
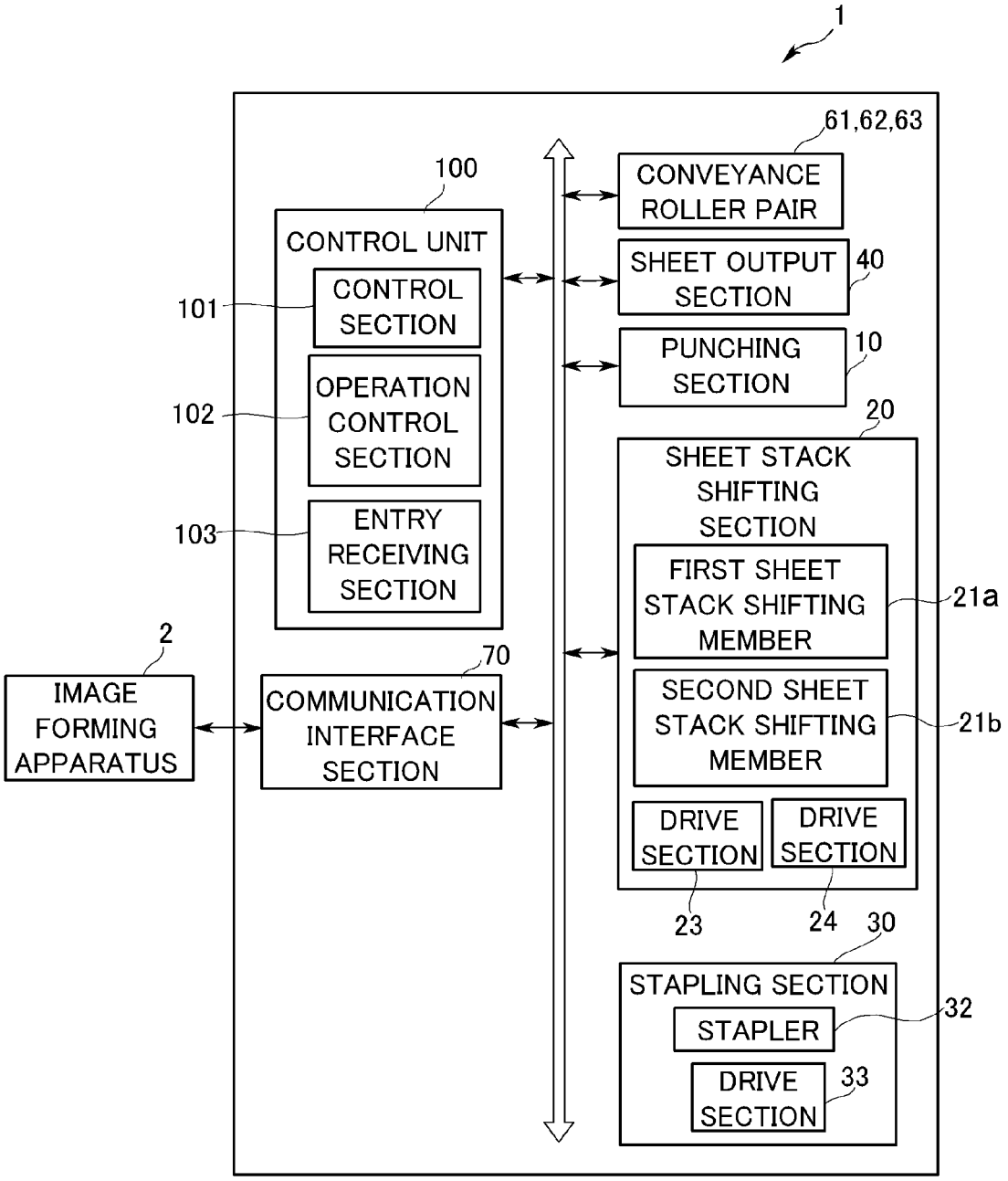
FIG. 5 is a block diagram showing an internal configuration of the post-processing device according to the one embodiment of the present disclosure.

FIG. 5 is a block diagram showing a schematic internal configuration of the post-processing device 1. The post-processing device 1 includes the punching section 10, the sheet stack shifting section 20, the stapling section 30, the sheet output section 40, the conveyance roller pairs 61, 62, 63, the communication interface section 70, and a control unit 100.

The communication interface section 70 includes a communication device for serial communications or so on and is connected to a communication interface section (not shown) of the image forming apparatus 2. The post-processing device 1 receives through the communication interface section 70 various commands and requests transmitted from the image forming apparatus 2 and transmits through the communication interface section 70 various notices to the image forming apparatus 2. Commands transmitted from the image forming apparatus 2 include a command to execute stapling, a command to specify the type of stapling (two-point binding, single-point binding, saddle stitch binding or the like), and a command to specify the output location where the stapled stack of paper sheets are to be discharged.

The control unit 100 is composed of a CPU (central processing unit), a RAM (random access memory), a ROM (read only memory), and so on. A post-processing control program stored in the aforementioned ROM or an internal storage section of the control unit 100 is executed by the aforementioned CPU, so that the control unit 100 functions as a control section 101, the operation control section 102, and an entry receiving section 103. Alternatively, each of the control section 101, the operation control section 102, and the entry receiving section 103 of the control unit 100 may not be implemented by the operation of the control unit 100 in accordance with the post-processing control program but may be constituted by a hardware circuit.

The control section 101 governs the overall control of the post-processing device 1.

The operation control section 102 has the function of controlling the operations of the punching section 10, the sheet stack shifting section 20, the stapling section 30, the sheet output section 40, and the conveyance roller pairs 61, 62, 63. The details of the above operation control of the operation control section 102 will be described hereinafter.

The entry receiving section 103 has the function of receiving through the communication interface section 70 various commands transmitted from the image forming apparatus 2, such as a command to execute stapling, a command to specify the type of stapling, and a command to specify the output location where the stapled stack of paper sheets are to be discharged. These commands are entered by a user, for example, using operating buttons or a touch panel function provided on the image forming apparatus 2.

Next, a description will be given of the operation of the post-processing device 1 having the aforementioned configuration. The following description will refer to the case where two stacks of paper sheets for two sets are stapled at two locations a predetermined distance apart on each stack. FIG. 6 is a flowchart showing a flow of processing of the post-processing device 1. FIGS. 7A to 7D show the movements of the first and second sheet stack shifting members 21*a*, 21*b* of the sheet stack shifting section 20 and the movement of the stapler 32 of the stapling section 30 during stapling of a stack of paper sheets for a first set shown in FIG. 6. FIGS. 8A to 8D show the movements of the first and second sheet stack shifting members 21*a*, 21*b* of the sheet stack shifting section 20 and the movement of the stapler 32 of the stapling section 30 during stapling of a stack of paper sheets for a second set shown in FIG. 6.

First, the entry receiving section 103 of the post-processing device 1 determines whether or not a command to execute stapling transmitted from the image forming apparatus 2 has been received (step S10).

If a command to execute stapling has been received (YES in step S10), the operation control section 102 controls a motor (not shown) operable to drive the conveyance roller pair 61 and a motor (not shown) operable to drive the conveyance roller pair 62 to rotate these conveyance roller pairs 61, 62 and thus allow them to convey into the processing tray 31 paper sheets fed through the sheet receiving port 50 (step S11).

If the entry receiving section 103 has received a command to execute punching, the operation control section 102 controls the motor (not shown) operable to drive the cams 11 to rotate the cams 11 and thus allow the punching blades 12 to punch holes at the predetermined locations in the paper sheet fed through the sheet receiving port 50.

The operation control section 102 determines whether or not the number of paper sheets P in a stack of paper sheets for a first set loaded on the processing tray 31 has reached a desired number for stapling (step S12). Information on this desired number for stapling is contained in the command transmitted from the image forming apparatus 2 and received by the entry receiving section 103.

Figure 7A:
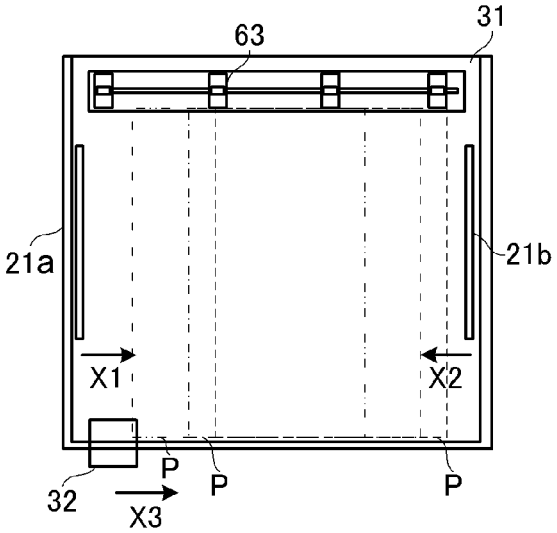
FIGS. 7A, 7B, 7C, and 7D show the movements or positions of first and second sheet stack shifting members of the sheet stack shifting section and the movement or position of the stapler of the stapling section during stapling for a first set of paper sheets shown in FIG. 6.

If the desired number for stapling is reached (YES in step S12), the operation control section 102 executes processing of step S13. FIG. 7A shows the movements of the first and second sheet stack shifting members 21*a*, 21*b* and the movement of the stapler 32 of the stapling section 30 in the processing of step S13.

In the processing of step S13, the operation control section 102 controls the drive section 23 operable to drive the first sheet stack shifting member 21*a* and the drive section 24 operable to drive the second sheet stack shifting member 21*b* to move the first sheet stack shifting member 21*a* in the direction X1 in the figure and move the second sheet stack shifting member 21*b* in the direction X2 in the figure, thus shifting the stack of paper sheets P loaded on the processing tray 31 along the width direction to collectively align the stack of paper sheets P.

Furthermore, in the processing of step S13, the operation control section 102 controls, in parallel with the process of moving the first and second sheet stack shifting members 21*a*, 21*b* to collectively align the stack of paper sheets P, the drive section 33 operable to drive the stapler 32 of the stapling section 30 to move the stapler 32 in the direction X3 in the figure and thus position the stapler 32 at a position to be corresponding to a location to be stapled first on the stack of paper sheets P.

Figure 7C:
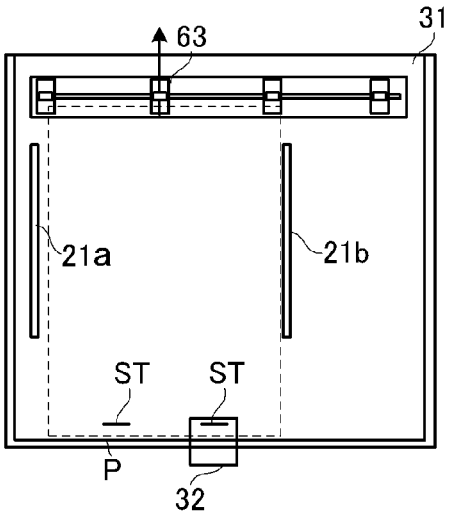
Figure 7B:
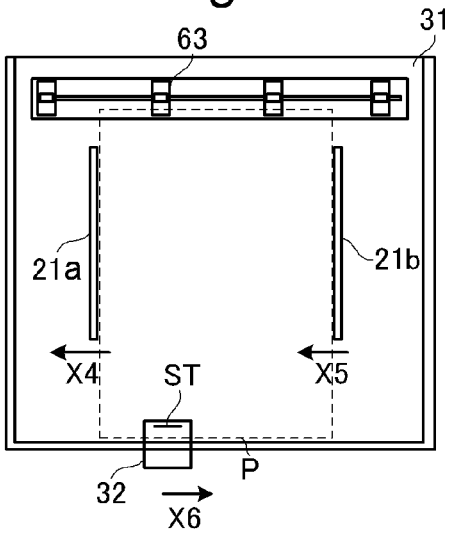

After the processing of step S13, the operation control section 102 controls the drive section 33 operable to drive the stapler 32 to allow the stapler 32 to apply a staple ST to the location to be stapled first on the stack of paper sheets P as shown in FIG. 7B (step S14).

After the processing of step S14, the operation control section 102 executes processing of step S15. FIG. 7B shows the movements of the first and second sheet stack shifting members 21*a*, 21*b* and the movement of the stapler 32 of the stapling section 30 in the processing of step S15.

In the processing of step S15, the operation control section 102 controls the drive section 23 operable to drive the first sheet stack shifting member 21*a* and the drive section 24 operable to drive the second sheet stack shifting member 21*b* to move the first sheet stack shifting member 21*a* in the direction X4 in the figure and move the second sheet stack shifting member 21*b* in the direction X5 in the figure, thus shifting the stack of paper sheets P loaded on the processing tray 31 along the width direction of the stack of paper sheets P. In this regard, the operation control section 102 allows the sheet stack shifting section 20 to shift the stack of paper sheets P to a discharge position through which the stack of paper sheets P will be discharged, as shown in FIG. 7C. Information on this discharge position for the stack of paper sheets P is contained in the command transmitted from the image forming apparatus 2 and received by the entry receiving section 103. If the command indicating the discharge position for the stack of paper sheets P has not been transmitted from the image forming apparatus 2, the operation control section 102 allows the sheet stack shifting section 20 to shift the stack of paper sheets P to a standard discharge position.

Furthermore, in the processing of step S15, the operation control section 102 controls, in parallel with the process of shifting the stack of paper sheets P along the width direction, the drive section 33 operable to drive the stapler 32 of the stapling section 30 to move the stapler 32 in the direction X6 in the FIG. 7B and thus position the stapler 32 at a position corresponding to a location to be stapled next on the stack of paper sheets P as shown in FIG. 7C.

After the processing of step S15, the operation control section 102 executes processing of step S16. FIG. 7C shows the positions of the first and second sheet stack shifting members 21*a*, 21*b* and the position of the stapler 32 of the stapling section 30 in the processing of step S16.

In the processing of step S16, the operation control section 102 controls the drive section 33 operable to drive the stapler 32 to allow the stapler 32 to apply a staple ST to the location to be stapled next on the stack of paper sheets P. Then, the operation control section 102 controls a motor (not shown) operable to drive the conveyance roller pair 63 to rotate them and thus allow the conveyance roller pair 63 to discharge the stack of paper sheets P toward the output tray 41 provided outside the post-processing device 1.

Figure 7D:
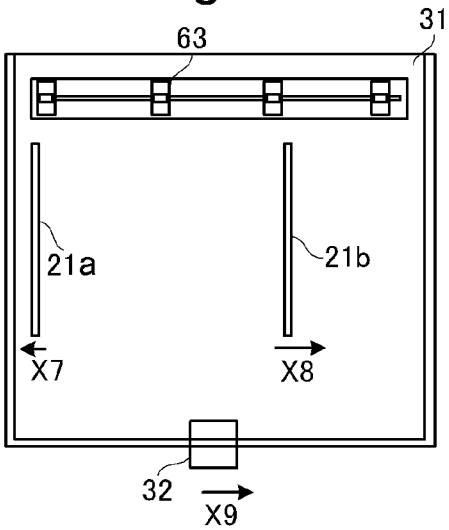

After the processing of step S16, the operation control section 102 executes processing of step S17. FIG. 7D shows the movements of the first and second sheet stack shifting members 21*a*, 21*b* and the movement of the stapler 32 of the stapling section 30 in the processing of step S17.

In the processing of step S17, the operation control section 102 controls the drive section 23 operable to drive the first sheet stack shifting member 21*a* and the drive section 24 operable to drive the second sheet stack shifting member 21*b* to move the first sheet stack shifting member 21*a* in the direction X7 in the figure and move the second sheet stack shifting member 21*b* in the direction X8 in the figure. In this regard, the operation control section 102 moves the first and second sheet stack shifting members 21*a*, 21*b* to their respective predetermined home positions with reference to signals output from the position sensors 25, 26 (not shown in FIG. 7D).

Furthermore, in the processing of step S17, the operation control section 102 controls, in parallel with the process of moving the first and second sheet stack shifting members 21*a*, 21*b* to their home positions, the drive section 33 operable to drive the stapler 32 of the stapling section 30 to move the stapler 32 in the direction X9 in the figure. In this regard, the operation control section 102 allows the stapler 32 to move to a position corresponding to a location to be stapled first on a stack of paper sheets for a second set. In doing so, the operation control section 102 determines as the location to be stapled first on the next stack of paper sheets, out of a plurality of locations to be stapled on the next stack of paper sheets, the nearest to the position where the stapler 32 has positioned when having applied a staple in step S16.

After the processing of step S17, the operation control section 102 controls the motor operable to drive the conveyance roller pair 61 and the motor operable to drive the conveyance roller pair 62 to rotate these conveyance roller pairs 61, 62 and thus allow them to convey into the processing tray 31 paper sheets for a second set fed through the sheet receiving port 50 (step S18).

The operation control section 102 determines whether or not the number of paper sheets in a stack of paper sheets for the second set loaded on the processing tray 31 has reached a desired number for stapling (step S19).

Figure 8A:
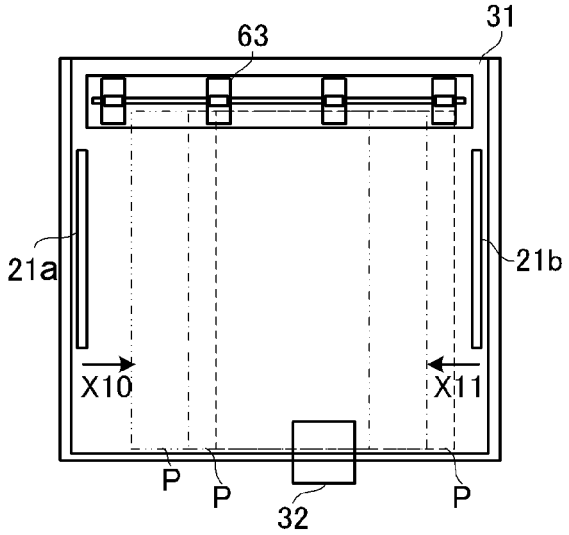
FIGS. 8A, 8B, 8C, and 8D show the movements or positions of the first and second sheet stack shifting members of the sheet stack shifting section and the movement or position of the stapler of the stapling section during stapling for a second set of paper sheets shown in FIG. 6.

If the desired number for stapling is reached (YES in step S19), the operation control section 102 executes processing of step S20. FIG. 8A shows the movements of the first and second sheet stack shifting members 21*a*, 21*b* and the movement of the stapler 32 of the stapling section 30 in the processing of step S20.

In the processing of step S20, the operation control section 102 controls the drive section 23 operable to drive the first sheet stack shifting member 21*a* and the drive section 24 operable to drive the second sheet stack shifting member 21*b* to move the first sheet stack shifting member 21*a* in the direction X10 in the figure and move the second sheet stack shifting member 21*b* in the direction X11 in the figure, thus shifting the stack of paper sheets P for the second set loaded on the processing tray 31 along the width direction to collectively align the stack of paper sheets P. At this time, the stapler 32 has already moved, in the processing of step 16, to the position corresponding to the location to be stapled first on the next stack of paper sheets and therefore no longer needs to be moved.

Figure 8C:
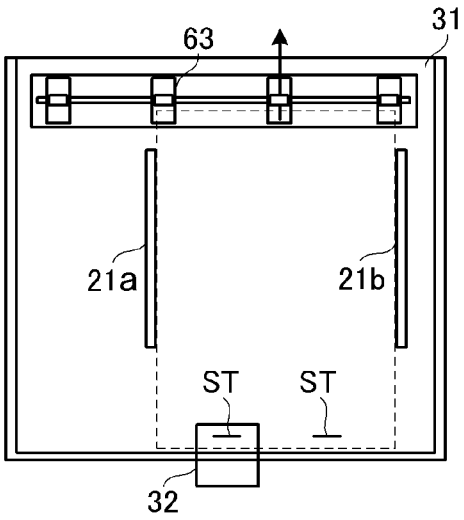
Figure 8B:
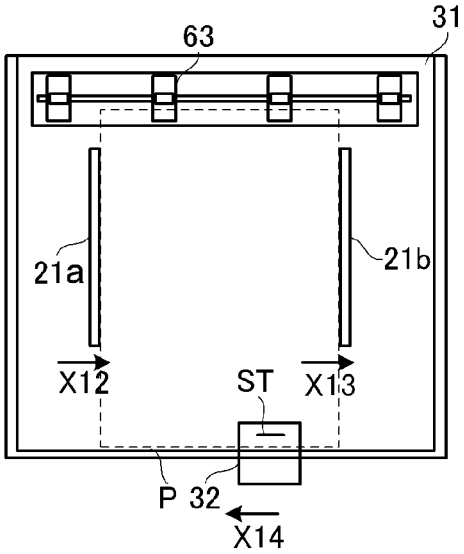

After the processing of step S20, the operation control section 102 controls the drive section 33 operable to drive the stapler 32 to allow the stapler 32 to apply a staple ST to the location to be stapled first on the stack of paper sheets P for the second set as shown in FIG. 8B (step S21).

After the processing of step S21, the operation control section 102 executes processing of step S22. FIG. 8B shows the movements of the first and second sheet stack shifting members 21*a*, 21*b* and the movement of the stapler 32 of the stapling section 30 in the processing of step S22.

In the processing of step S22, the operation control section 102 executes processing similar to the processing of step S15. Specifically, the operation control section 102 controls the drive section 23 operable to drive the first sheet stack shifting member 21*a* and the drive section 24 operable to drive the second sheet stack shifting member 21*b* to move the first sheet stack shifting member 21*a* in the direction X12 in the figure and move the second sheet stack shifting member 21*b* in the direction X13 in the figure, thus shifting the stack of paper sheets P loaded on the processing tray 31 along the width direction of the stack of paper sheets P. In this regard, the operation control section 102 allows the sheet stack shifting section 20 to shift the stack of paper sheets P to a discharge position through which the stack of paper sheets P for the second set will be discharged, as shown in FIG. 8C. Furthermore, the operation control section 102 controls, in parallel with the process of shifting the stack of paper sheets P for the second set along the width direction, the drive section 33 operable to drive the stapler 32 of the stapling section 30 to move the stapler 32 in the direction X14 in the FIG. 8B and thus position the stapler 32 at a position corresponding to a location to be stapled next on the stack of paper sheets P for the second set as shown in FIG. 8C.

After the processing of step S22, the operation control section 102 executes processing of step S23. FIG. 8C shows the positions of the first and second sheet stack shifting members 21*a*, 21*b* and the position of the stapler 32 of the stapling section 30 in the processing of step S23.

In the processing of step S23, the operation control section 102 executes processing similar to the processing of step S16. Specifically, the operation control section 102 controls the drive section 33 operable to drive the stapler 32 to allow the stapler 32 to apply a staple ST to the location to be stapled next on the stack of paper sheets P for the second set. Then, the operation control section 102 controls the motor operable to drive the conveyance roller pair 63 to rotate them and thus allow the conveyance roller pair 63 to discharge the stack of paper sheets P for the second set toward the output tray 41 provided outside the post-processing device 1.

Figure 8D:
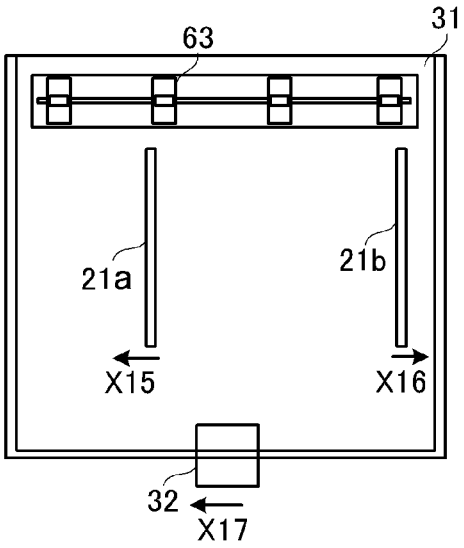

After the processing of step S23, the operation control section 102 executes processing of step S24. FIG. 8D shows the movements of the first and second sheet stack shifting members 21*a*, 21*b* and the movement of the stapler 32 of the stapling section 30 in the processing of step S24.

In the processing of step S24, the operation control section 102 controls the drive section 23 operable to drive the first sheet stack shifting member 21*a* and the drive section 24 operable to drive the second sheet stack shifting member 21*b* to move the first sheet stack shifting member 21*a* in the direction X15 in the figure and move the second sheet stack shifting member 21*b* in the direction X16 in the figure, thus moving the first and second sheet stack shifting members 21*a*, 21*b* to their respective predetermined home positions. In this regard, the operation control section 102 moves the first and second sheet stack shifting members 21*a*, 21*b* to their respective predetermined home positions with reference to signals output from the position sensors 25, 26 (not shown in FIG. 8D).

Furthermore, in the processing of step S24, in parallel with the process of moving the first and second sheet stack shifting members 21*a*, 21*b* to their home positions, the operation control section 102 allows the stapler 32 to slide in the direction X17 in the figure. In this regard, the operation control section 102 allows the stapler 32 to move to its predetermined home position with reference to a signal output from the position sensor 35 (not shown in FIG. 8D).

In the post-processing device 1 according to this embodiment, in allowing the stapler 32 to apply a staple to a location to be stapled last on the previous stack of paper sheets P and then successively apply staples to a next stack of paper sheets P, the stapler 32 is not returned to its home position but moved to a position corresponding to a location to be stapled on the next stack of paper sheets P, which is nearer the last stapled location on the previous stack of paper sheets P than the home position. Then, in the case the stapler 32 does not apply a staple to a second next stack of paper sheets P until a predetermined time elapses after the stapler 32 has applied a staple to a location to be stapled last on the previous stack of paper sheets P, the stapler 32 is returned to its home position.

Next, a description will be given of effects of the post-processing device 1 according to this embodiment in comparison with a post-processing device according to a comparative example. FIGS. 9A to 9F show the movements of first and second sheet stack shifting members 121*a*, 121*b* of a sheet stack shifting section 120 and a stapler 132 of a stapling section 130 in a post-processing device according to a comparative example during stapling for first and second sets of paper sheets.

Figure 9A:
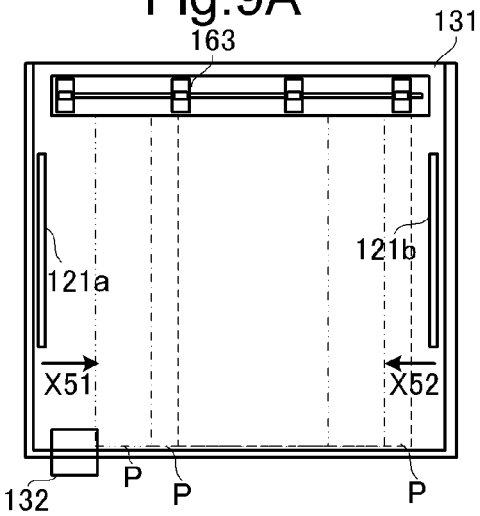
FIGS. 9A, 9B, 9C, 9D, 9E and 9F show the movements or positions of first and second sheet stack shifting members of a sheet stack shifting section and the movement or position of a stapler of a stapling section in a post-processing device according to a comparative example during stapling for first and second sets of paper sheets.
Figure 9D:
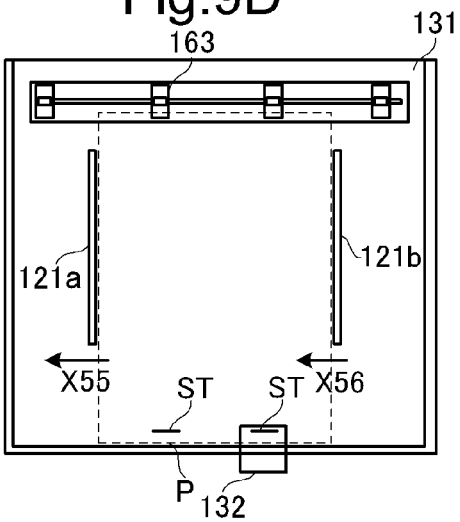
Figure 9B:
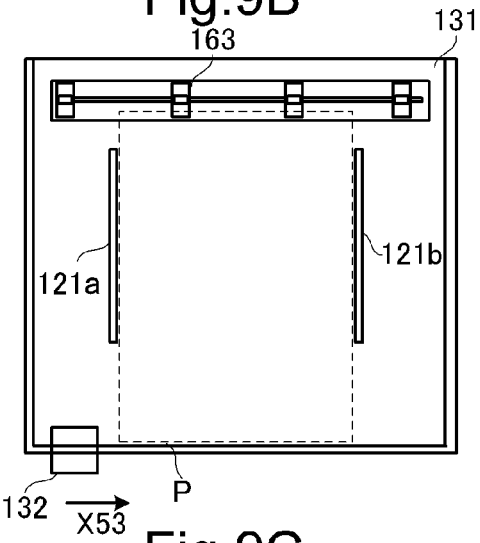

When the number of paper sheets in a stack of paper sheets P for a first set reaches a desired number for stapling, as shown in FIG. 9A, the post-processing device according to the comparative example allows the first sheet stack shifting member 121*a* to move in the direction X51 in the figure and allows the second sheet stack shifting member 121*b* to move in the direction X52 in the figure, thus shifting the stack of paper sheets P loaded on a processing tray 131 along the width direction to collectively align it. Thereafter, as shown in FIG. 9B, the post-processing device according to the comparative example allows the stapler 132 to slide in the direction X53 in the figure and thus positions the stapler 132 at a position corresponding to a location to be stapled first on the stack of paper sheets P.

In contrast, the post-processing device 1 according to this embodiment allows the stapler 32 to move to a position corresponding to a location to be stapled first on the stack of paper sheets P, in parallel with the process of moving the first and second sheet stack shifting members 21*a*, 21*b* to collectively align the stack of paper sheets P. Therefore, the time taken to move the stapler 32 to a position corresponding to a location to be stapled first on the stack of paper sheets P can be reduced.

Figure 9E:
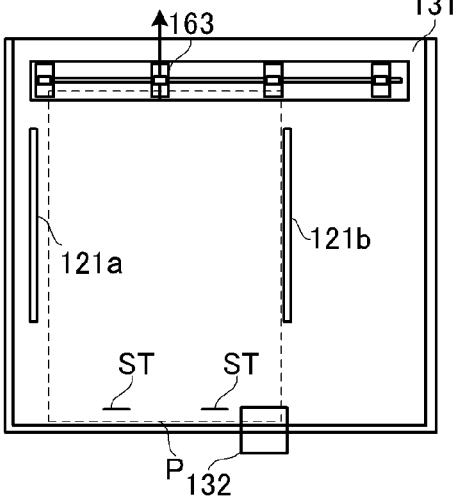
Figure 9C:
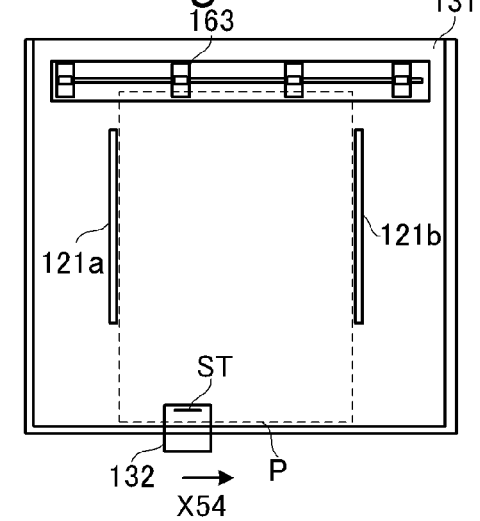

As shown in FIG. 9C, the post-processing device according to the comparative example allows the stapler 132 to apply a staple ST to the location to be stapled first on the stack of paper sheets P, then allows the stapler 132 to slide in the direction X54 in the figure, and thus positions the stapler 132 at a position corresponding to a location to be stapled next on the stack of paper sheets P. Then, as shown in FIG. 9D, the post-processing device according to the comparative example allows the stapler 132 to apply a staple ST to the location to be stapled next on the stack of paper sheets P, then allows the first sheet stack shifting member 121*a* to move in the direction X55 in the figure, and allows the second sheet stack shifting member 121*b* to move in the direction X56 in the figure, thus shifting the stack of paper sheets P loaded on the processing tray 131 to a discharge position through which the stack of paper sheets P will be discharged. Thereafter, the post-processing device according to the comparative example discharges the stack of paper sheets P by rotating a conveyance roller pair 163 as shown in FIG. 9E.

Unlike the above, the post-processing device 1 according to this embodiment allows the stapler 32 to apply a staple ST to a first location on the stack of paper sheets P and then allows the stapler 32 to move to a position corresponding to a second location to be stapled next on the stack of paper sheets P while allowing the sheet stack shifting section 20 to shift the stack of paper sheets P in the direction opposite to the direction of movement of the stapler 32. Therefore, the travel distance of the stapler 32 for applying a staple to the location to be stapled next can be reduced, resulting in reduced time taken to complete the stapling process. In addition, the electrical power taken to drive the stapler 32 can be reduced to cut the power consumption of the post-processing device 1.

Furthermore, the post-processing device 1 according to this embodiment allows the stapler 32 to move to a position corresponding to a location to be stapled last on the stack of paper sheets P while allowing the sheet stack shifting section 20 to shift the stack of paper sheets P to a discharge position through which the stack of paper sheets P will be discharged. Therefore, there is no longer need to shift the stack of paper sheets P to the discharge position after the stapling process, which enables earlier provision of the stapled stack of paper sheets P to the user.

Figure 9F:
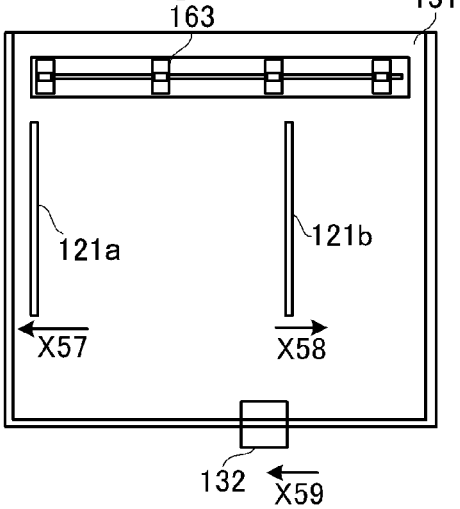

As shown in FIG. 9F, after the stapling process, the post-processing device according to the comparative example allows the first sheet stack shifting member 121*a* to move in the direction X57 in the figure, allows the second sheet stack shifting member 121*b* to move in the direction X58 in the figure, and allows the stapler 132 to move in the direction X59 in the figure, thus moving the first and second sheet stack shifting members 121*a*, 121*b* and the stapler 132 to their predetermined home positions.

Then, as shown in FIGS. 9A to 9F, the post-processing device according to the comparative example subjects a stack of paper sheets P for a second set to the same stapling and discharge processes as those subjected to the stack of paper sheets P for the first set.

In contrast, in the case where the post-processing device 1 according to this embodiment allows the stapler 32 to apply a staple to a location to be stapled last on the stack of paper sheets P and successively apply staples to a next stack of paper sheets P, the stapler 32 is not returned to its home position but moved to a position corresponding to a location to be stapled first on the next stack of paper sheets P. Furthermore, the post-processing device 1 according to this embodiment determines as the location to be stapled first on the next stack of paper sheets P, out of a plurality of locations to be stapled on the next stack of paper sheets P, the nearest to a position where the stapler 32 has positioned when having applied a staple to a location to be stapled last on the previous stack of paper sheets P. Thus, since, at each start of stapling of stacks of paper sheets for second and later sets, the stapler 32 has already moved to a position corresponding to a location to be stapled first on the stack of paper sheets, there is no longer need to move the stapler 32 to the position, resulting in reduced time taken to complete the stapling process. In addition, the electrical power taken to drive the stapler 32 can be reduced to cut the power consumption of the post-processing device 1.

As seen from the above, since the post-processing device according to the comparative example moves the stapler before the stapler applies a staple to each of a plurality of locations on the stack of paper sheets, the stapling process takes a long time to complete. Furthermore, after the stapling process, the sheet stack shifting section needs to shift the stack of paper sheets to a predetermined discharge position, so that it takes further time to discharge the stapled stack of paper sheets to an output tray. It may be conceivable to provide the post-processing device with a plurality of staplers to reduce the travel time of each stapler and thus reduce the time taken to complete the stapling process. In this case, however, the post-processing device is complicated in structure and increased in size.

The post-processing device 1 according to this embodiment has a simple structure and requires a shorter time to complete the stapling process than the post-processing device according to the comparative example.

The following is a supplement to the contents described in the above embodiment.

Although the flowchart shown in FIG. 6 illustrates the case where the stack of paper sheets P is stapled at two locations a predetermined distance apart thereon, the same processing can also be executed in the case where the stack of paper sheets P is stapled at three or more locations thereon. Thus, the travel distance of the stapler 32 can be reduced, resulting in reduced time taken to complete the stapling process. In addition, the electrical power taken to drive the stapler 32 can be reduced to cut the power consumption of the post-processing device 1.

Furthermore, when a stack of paper sheets P to be stapled has a small size, the distance between locations to be stapled on the stack is small, so that the time to complete the stapling process that can be reduced even by the processing of the above embodiment may be small. Therefore, when the distance between locations to be stapled on the stack is smaller than a predetermined distance, the operation control section 102 may not execute the processing shown in the above embodiment but instead may execute the processing shown in the comparative example.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A post-processing device comprising:

a tray capable of being loaded with a stack of paper sheets to be stapled;

a sheet output section configured to discharge the stapled stack of paper sheets from the tray;

a stapler provided movably in a direction perpendicular to a direction of the discharge of the stack of paper sheets and configured to apply staples to a plurality of locations on the stack of paper sheets loaded on the tray;

a sheet stack shifting section configured to shift the stack of paper sheets loaded on the tray in the direction perpendicular to the direction of the discharge of the stack; and an operation control section configured to control operations of the stapler and the sheet stack shifting section, wherein the operation control section allows the stapler to apply a staple to a first one of the locations on the stack of paper sheets and then allows the stapler to move to a position corresponding to a second one of the locations to be stapled next on the stack of paper sheets while allowing the sheet stack shifting section to shift the stack of paper sheets in a direction opposite to a direction of the movement of the stapler.

2. The post-processing device according to claim 1, wherein the operation control section allows the stapler to move to a position corresponding to a last one of the locations to be stapled last on the stack of paper sheets while allowing the sheet stack shifting section to shift the stack of paper sheets to a discharge position through which the stack of paper sheets will be discharged.

3. The post-processing device according to claim 1, wherein in allowing the stapler to apply a staple to a last one of the locations to be stapled last on the stack of paper sheets and then successively apply staples to a next stack of paper sheets, the operation control section avoids return of the stapler to a home position thereof and allows the stapler to move to a position corresponding to a location to be stapled first on the next stack of paper sheets.

4. The post-processing device according to claim 3, wherein the operation control section determines as the location to be stapled first on the next stack of paper sheets, out of a plurality of locations to be stapled on the next stack of paper sheets, the nearest to a position where the stapler has positioned when having applied the staple to the last location to be stapled last on the previous stack of paper sheets.

5. The post-processing device according to claim 3, wherein in the case the stapler does not apply a staple to the next stack of paper sheets until a predetermined time elapses after the stapler has applied the staple to the last location to be stapled last on the previous stack of paper sheets, the operation control section allows the stapler to return to the home position.

6. The post-processing device according to claim 1, wherein when a distance between the locations to be stapled on the stack of paper sheets is a predetermined distance or more, the operation control section executes processing for allowing the stapler to apply a staple to the first location on the stack of paper sheets and then allowing the stapler to move to the position corresponding to the second location to be stapled next on the stack of paper sheets while allowing the sheet stack shifting section to shift the stack of paper sheets in the direction opposite to the direction of the movement of the stapler.

7. An image forming apparatus comprising:

an image forming section configured to form an image on a paper; and a post-processing devices configured to subject a stack of paper sheets to be stapled to stapling, the stack of paper sheets comprising a plurality of paper having images formed thereon by the image forming apparatus, wherein the post-processing device comprises:

a tray capable of being loaded with the stack of paper sheets;

a sheet output section configured to discharge the stapled stack of paper sheets from the tray;

a stapler provided movably in a direction perpendicular to a direction of the discharge of the stack of paper sheets and configured to apply staples to a plurality of locations on the stack of paper sheets loaded on the tray;

a sheet stack shifting section configured to shift the stack of paper sheets loaded on the tray in the direction perpendicular to the direction of the discharge of the stack; and an operation control section configured to control operations of the stapler and the sheet stack shifting section, and wherein the operation control section allows the stapler to apply a staple to a first one of the locations on the stack of paper sheets and then allows the stapler to move to a position corresponding to a second one of the locations to be stapled next on the stack of paper sheets while allowing the sheet stack shifting section to shift the stack of paper sheets in a direction opposite to a direction of the movement of the stapler.

* * * * *